US006146254A

United States Patent [19]

Wang

[11] Patent Number: 6,146,254

[45] Date of Patent: Nov. 14, 2000

[54] SANDER HAVING TWO OR MORE SANDER WHEELS

[76] Inventor: Tien Wang Wang, No. 45, Yi Chang East Road, Taiping City, Taichung Hsien, Taiwan

[21] Appl. No.: 09/289,811

[22] Filed: Apr. 12, 1999

[51] Int. Cl.[7] ..... B24B 7/00

[52] U.S. Cl. ..... 451/65; 451/188

[58] Field of Search ..... 451/188, 182, 451/178, 207, 131, 130, 65, 331, 358, 545, 914, 177

[56] References Cited

U.S. PATENT DOCUMENTS

| | | | |
|---|---|---|---|
| 441,634 | 12/1890 | Bennett et al. | 451/65 |
| 645,578 | 3/1900 | Thomas | 451/65 |
| 824,482 | 6/1906 | Holtmann | 451/65 |
| 2,463,750 | 3/1949 | Curtin | 451/188 |
| 5,531,636 | 7/1996 | Bissen | 451/65 |
| 5,582,539 | 12/1996 | Wang | 451/188 |

*Primary Examiner*—Robert A. Rose
*Attorney, Agent, or Firm*—Charles E. Baxley

[57] ABSTRACT

A sander includes two sander wheels of different sanding devices are rotatable secured on top of a frame. A work table is slidably disposed in the frame for supporting work pieces and for moving the work pieces toward the sander wheels. A pair of rollers are rotatable supported beside the sander wheels for feeding the work pieces passing through the sander wheels. A motor is coupled to the sander wheels and the rollers for driving the sander wheels and the rollers simultaneously. A reduction gearing is coupled to the rollers to drive the rollers in a reduced speed.

6 Claims, 4 Drawing Sheets

SANDER HAVING TWO OR MORE SANDER WHEELS

BACKGROUND OF THE INVENTION

1. Field of the Invention

The present invention relates to a sander, and more particularly to a sander having two or more sander wheels for sanding the work pieces.

2. Description of the Prior Art

The closest prior art of which the applicant is aware is his prior U.S. Pat. No. 5,582,539 to Wang and comprise a sander having a sander wheel disposed between two feeder rollers for allowing the work piece to be moved inward of the sander by the feeder rollers and to be sanded by the sander wheel easily. However, normally, the work pieces are required to be sanded with a coarse sanding device first and then to be sanded with one or more fine sanding devices. However, two or more sanders are required for providing different sanding devices to sand the work pieces. The operators have to spend a lot of time to move the work pieces between the sanders.

The present invention has arisen to mitigate and/or obviate the afore-described disadvantages of the conventional sanders.

SUMMARY OF THE INVENTION

The primary objective of the present invention is to provide a sander which includes two or more sander wheels for sanding the work piece with two or more different sanding devices simultaneously and for allowing the work pieces to be finished with the grinding operations with a single sander machine.

In accordance with one aspect of the invention, there is provided a sander comprising a frame, a housing disposed on top of the frame, a front sander wheel and one or more rear sander wheels rotatably secured in the housing, a work table slideably received in the frame for supporting work pieces, means for moving the work table upward toward and downward away from the sander wheels and to move the work pieces toward and away from the sander wheels, means for feeding the work pieces passing through the sander wheels, and means for driving the front sander wheel and the rear sander wheel to work on the work pieces.

The frame includes a pair of posts, the work table is slidably secured to the posts and to move up and down along the posts, the moving means includes at least one bolt threaded through the work table, and means for rotating the bolt to move the work table up and down. The rotating means includes a handle secured to the bolt for rotating the bolt.

Alternatively, the moving means includes a pair of bolts threaded through the work table, and a rod laterally and rotatably disposed in the frame, the rods includes two bevel gears secured thereto engaged with the bevel gears of the bolts for coupling the bolts together, and a handle secured to a first of the bolts and to move the work table tip and down by rotating type bolts simultaneously.

The front sander wheel and the rear sander wheel are each rotatably secured in the housing at a pivot shaft, the driving means includes a motor, and means for coupling the motor to the pivot shafts, the front sander wheel and the rear sander wheel are driven by the motor simultaneously. The feeding means includes a pair of rollers each rotatably secured in the housing at a pivot shaft, and a reduction gearing means for coupling the pivot shafts of the front sander wheel and the rear sander wheel to the pivot shafts of the rollers and to driven the rollers in a reduced rotational speed.

The front sander wheel includes a coarse sanding device and the rear sander wheel includes a fine sanding device for finish sanding the work pieces simultaneously.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
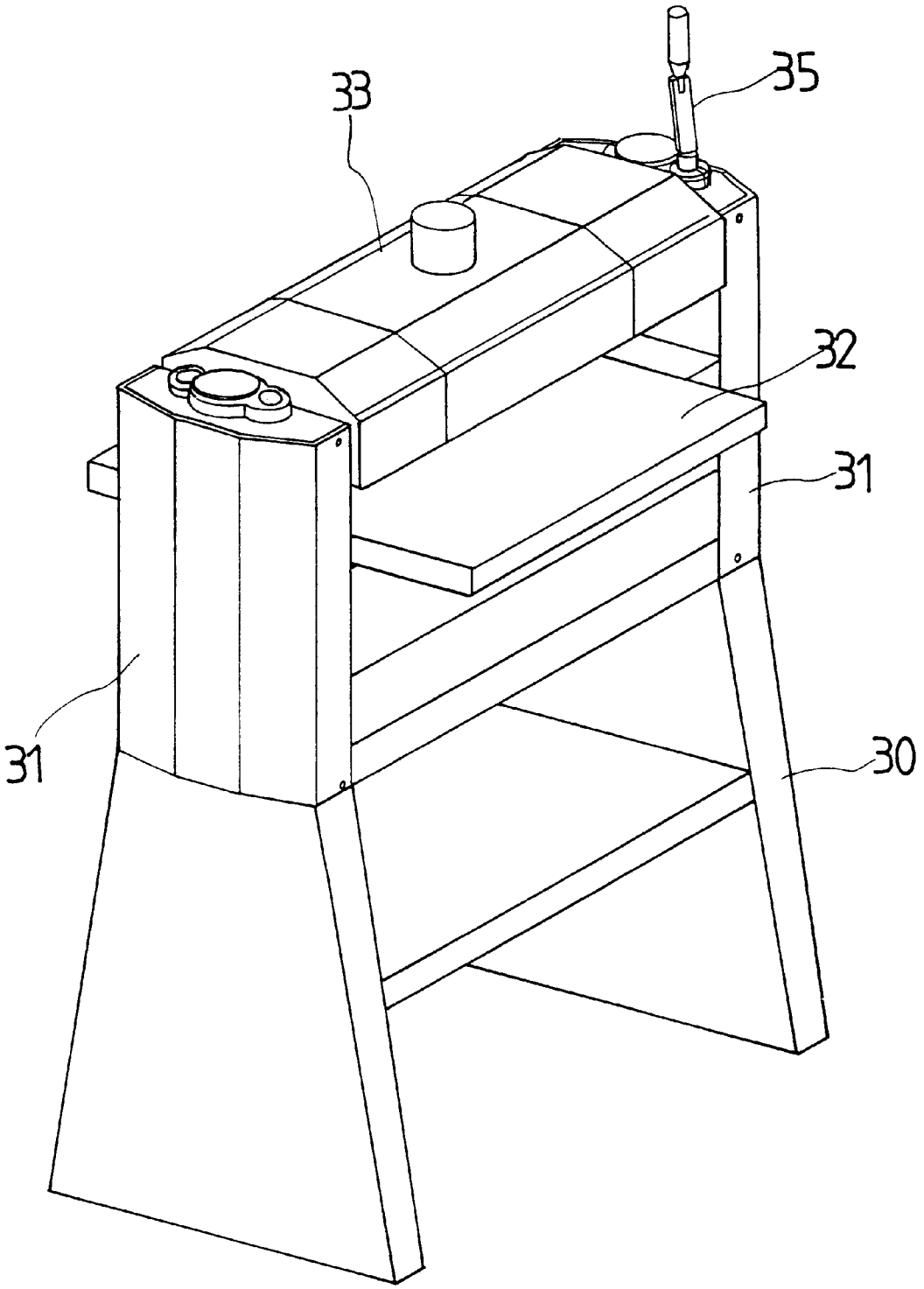
FIG. 1 is a perspective view of a sander in accordance with the present invention.
Figure 2:
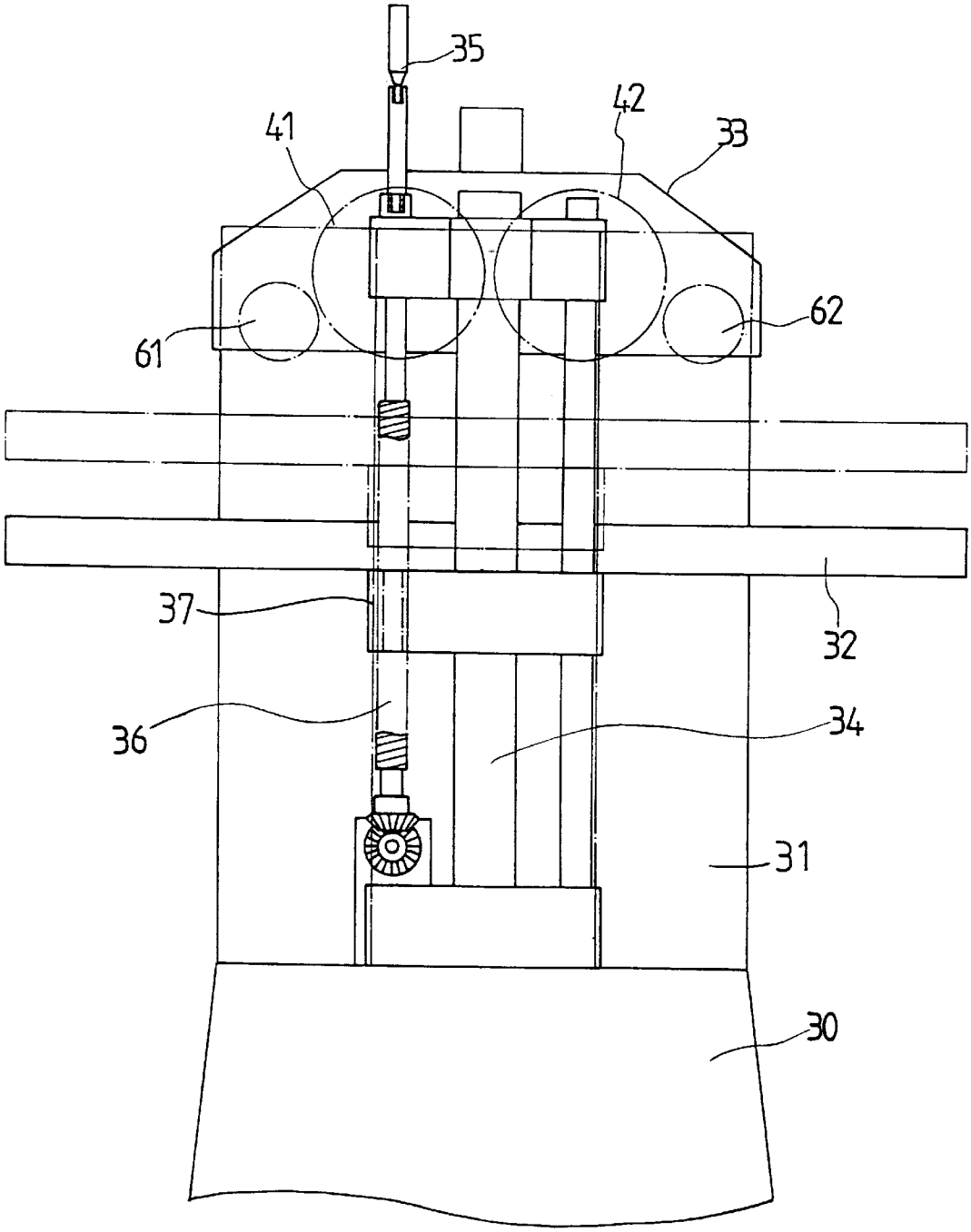
FIG. 2 is a side schematic view of the sander.
Figure 4:
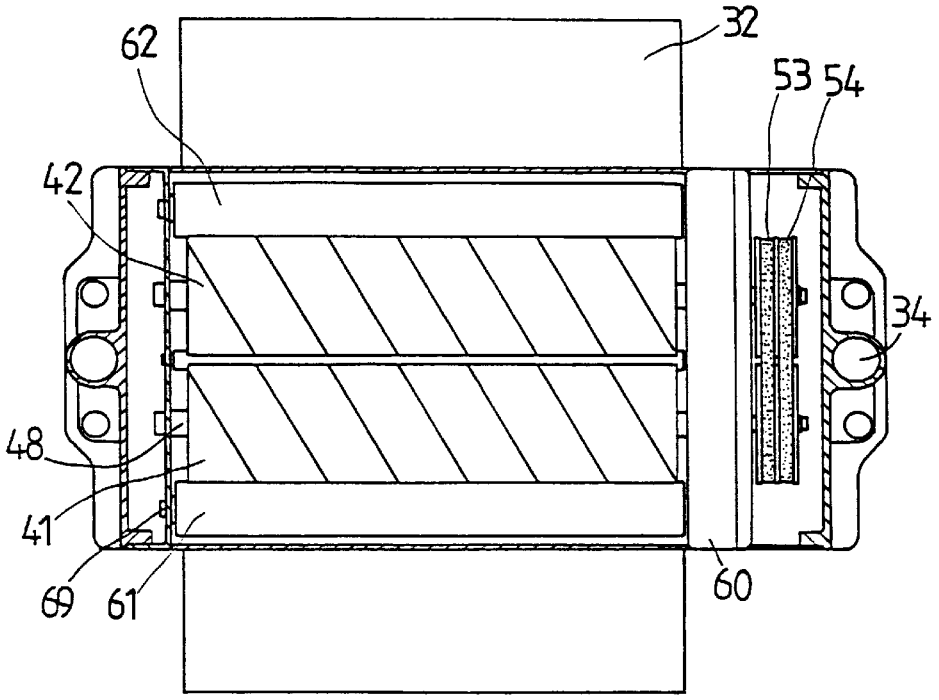
FIG. 4 is a top view of the sander, in which an upper portion of a casing is cut off or removed.
Figure 3:
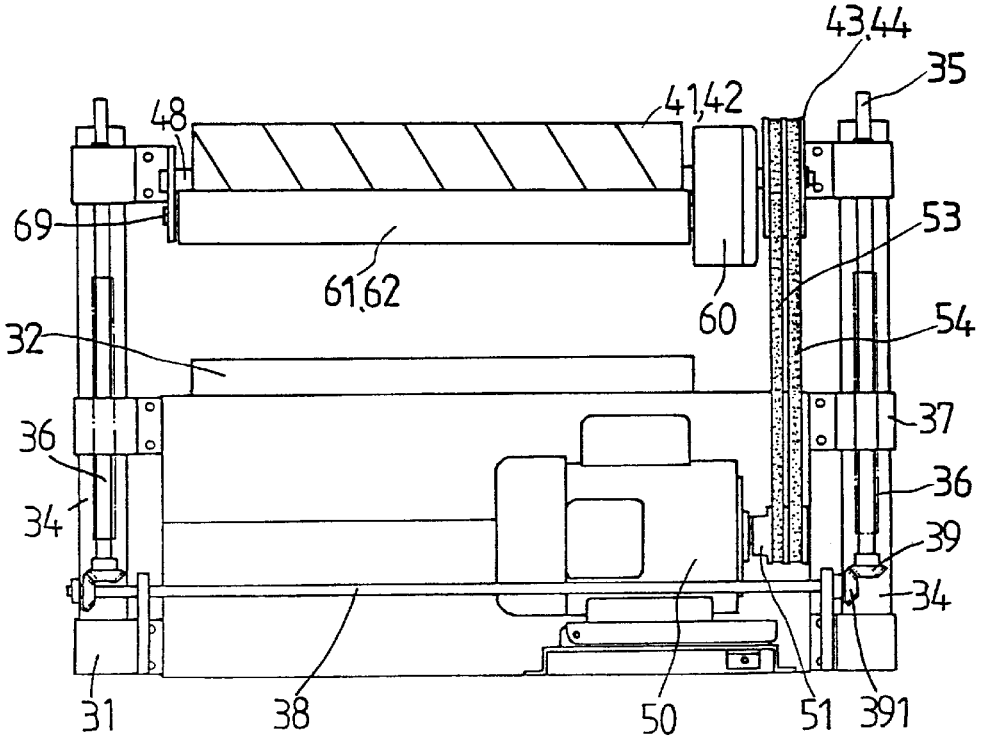
FIG. 3 is a front view of the sander, in which a portion of the housing is cut off for showing the inner structure of the sander.

Referring to the drawings, and initially to FIGS. 1–4, a sander in accordance with the present invention comprises a frame 31 secured on top of a base 30. The frame 31 includes one or more posts 34 extended upward therefrom. A housing 33 is provided on top of the frame 31. A work table 32 includes two sleeves 37 secured to the side portions and slidably engaged on the posts 34 for allowing the work table 32 to be moved tip and down along the posts 34. A pair of bolts 36 are rotatably secured in the frame 31 and threaded with the sleeves 37 of the work table 32 for moving the work table 32 up and down by rotating the bolts 36. The bolts 36 each includes a bevel gear 39 secured to the bottom thereof. A rod 38 is laterally and rotatably disposed in the bottom of the frame 31 and includes two ends each having a bevel gear 391 secured thereto and engaged with the bevel gear 39 of the bolts 36 for coupling the bolts 36 together. One of the bolts 36 includes a handle 35 provided on top for rotating the bolts 36 to move the work table 32 up and down along the posts 34. A motor may further be provided and coupled to the bolts 36 or to the bevel gears 39, 391 for driving the work table 32 up and down.

Two rollers 61, 62 and two or more sander wheels 41, 42 are each rotatably supported in the housing 33 at a respective pivot shaft 48, 69. The rollers 61, 62 are provided for engaging with the work piece and for feeding the work piece inward and outward of the sander. The sander wheels 41, 42 are provided for sanding the work piece. It is preferable that the front sander wheel 41 includes a coarse sanding member for firstly sanding the work piece, and the rear sander wheel(s) 42 includes a fine sanding member for finishing the grinding operation to the work piece. Referring next to FIG. 5 and again to FIGS. 3 and 4, two sprockets or pulleys 43, 44 are secured to the pivot shafts 48 of the sander wheels 41, 42 and rotated in concert with the sander wheels 41, 42. A motor 50 includes two sprockets or two pulleys 51 coupled to the sprockets or pulleys 43, 44 by chains or belts 53, 54 for driving the sander wheels 41, 42 simultaneously. Three or more sander wheels 41, 42 may be rotatably supported in the housing 33 for providing different sanding devices to work on the work pieces.

Figure 5:
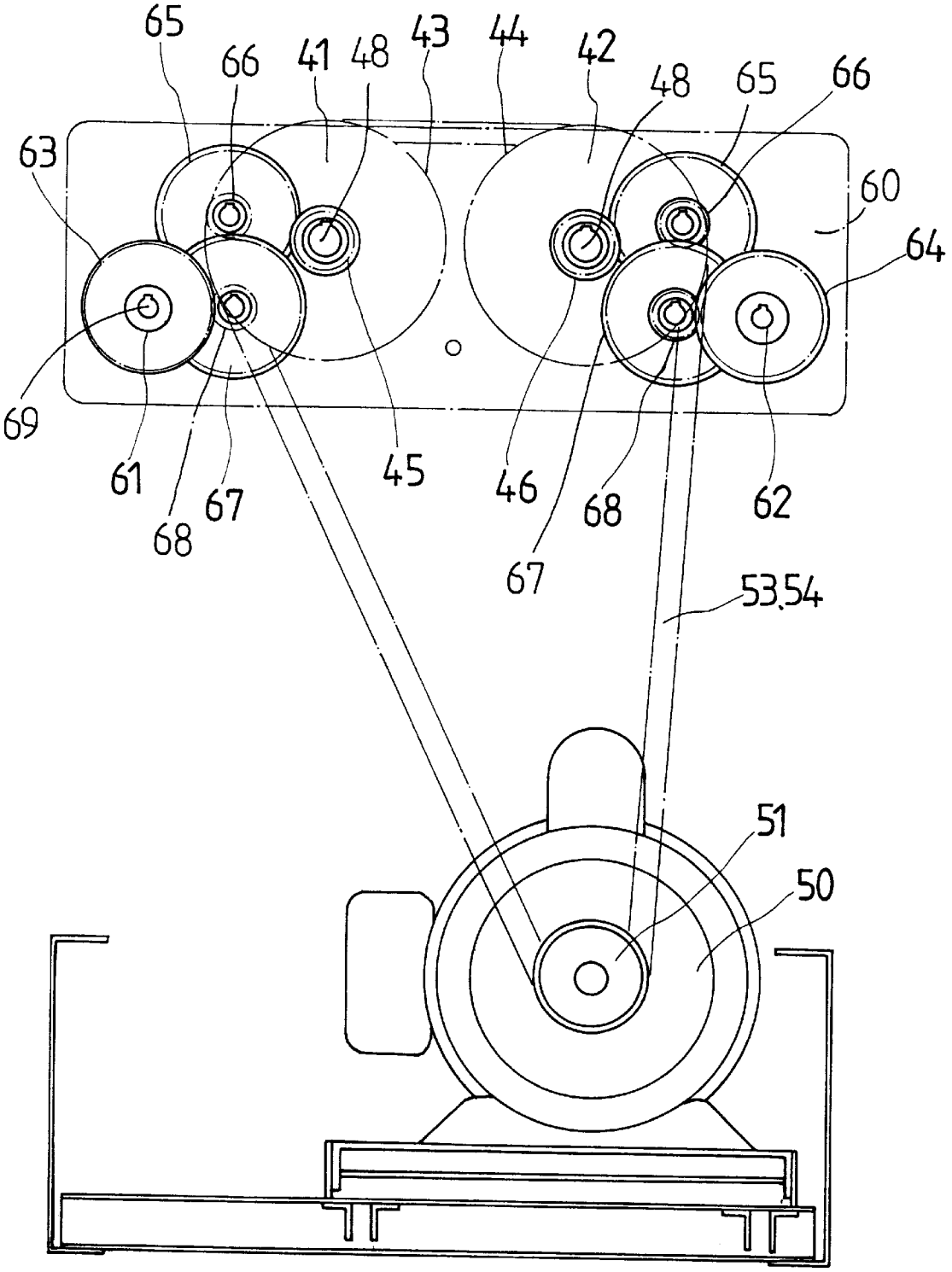
FIG. 5 is a plane schematic view illustrating the reduction gearing of the sander.

As best shown in FIG. 5, a reduction gearing 60 includes two pinions 45, 46 secured to the pivot shafts 48 of the sander wheels 41, 42 respectively and rotated in concert with the sander wheels 41, 429. Two gears 63, 64 are secured to the pivot shafts 69 of the rollers 61, 62 respectively and rotated in concert with the rollers 61, 62. Two pairs of gears 65, 67 are rotatably secured in the housing of the reduction gearing 60. The gears 65 are engaged with the respective pinions 45, 46 and each includes a pinion 66 secured thereto and engaged with the gears 67. The gears 67 each also includes a pinion 68 secured thereto and engaged with the respective gear 63, 64 such that the rollers 61, 62 may be driven by the motor 50 with a reduced speed as compared with the rotational speed of the sander wheel 41, 42.

In operation, the work pieces are supported on the work table 32 and may be moved upward toward or downward away from the sander wheels 41, 42 by rotating the handle 35 to move the work table 32 up and down. The rollers 61, 62 may, be used to move and to feed the work pieces forward by a reduced rotational speed via the reduction gearing 60 such that the work pieces may be fed forward with a suitable speed. The sander wheel 41, 42 are directly coupled to the motor 50 by the sprockets-and-chains mechanism or by the pulleys-and-belts mechanism such that the sander wheels 41, 42 may be driven with a greater rotational speed so as to conduct grinding operations to the work piece. It is only required for the users to move the work table 32 and the work pieces upward toward and downward away from the sander wheels 41, 42 by the handle 35 such that the sander may be easily operated.

Accordingly, the sander in accordance with the present invention includes two sander wheels and a pair of rollers that may be driven by a single motor. In addition, the sander wheels may be rotated with a greater speed for conducting grinding operations, and the rollers may be rotated with a reduced speed so as to feed the work pieces with a suitable speed. The sander wheels may include different sanding devices for sanding the work pieces with the different sanding devices and for finishing the sanding operations simultaneously with a single sander machine.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sander comprising:

a) a frame including a pair of posts, b) a housing disposed on top of said frame.

c) a front sander wheel and at least one rear sander wheel rotatably secured in said housing, d) a work table slidably received in said frame for supporting work pieces, said work table being slidably secured on said posts to move up and down along said posts, e) means for moving said work table upward toward and downward away from said sander wheels, said moving means including:

i) a pair of bolts threaded through said work table, said bolts each including a bevel gear secured thereto, ii) a rod laterally and rotatable disposed in said frame, said rod including two bevel gears secured thereto and engaged with said bevel gears of said bolts to couple said bolts together, and iii) a handle secured to a first of said bolts and to move said work table up and down by rotating said bolts simultaneously, f) means for feeding the work pieces passing through said sander wheels, and g) means for driving said front sander wheel and said at least one rear sander wheel to work on the work pieces.

2. A sander according to claim 1, wherein said frame includes a pair of posts, said work table is slidably secured to said posts and to move up and down along said posts, said moving means includes at least one bolt threaded through said work table, and means for rotating said at least one bolt to move said work table up and down.

3. A sander according to claim 2, wherein said rotating means includes a handle secured to said at least one bolt for rotating said at least one bolt.

4. A sander according to claim 1, wherein said front sander wheel and said rear sander wheel are each rotatably secured in said housing at a pivot shaft, said driving means includes a motor, and means for coupling said motor to said pivot shafts, said front sander wheel and said at least one rear sander wheel are driven by said motor simultaneously.

5. A sander according to claim 4, wherein said feeding means includes a pair of rollers each rotatably secured in said housing at a pivot shaft, and a reduction gearing means for coupling said pivot shafts of said front sander wheel and said at least one rear sander wheel to said pivot shafts of said rollers and to driven said rollers in a reduced rotational speed.

6. A sander according to claim 1, wherein said front sander wheel and said at least one rear sander wheel include different sanding devices.

* * * * *